US006619225B1

(12) United States Patent
Presniakov et al.

(10) Patent No.: US 6,619,225 B1
(45) Date of Patent: Sep. 16, 2003

(54) WHISTLE FOR MULTI-IMPLEMENT FOLDING KNIFE

(76) Inventors: Alexander Presniakov, 775-42nd Ave., San Francisco, CA (US) 94121; George M. Davison, III, 65 W. Chapel Ridge Rd., Pittsburgh, PA (US) 15238

( * ) Notice: Subject to any disclaimer, the term of this patent is extended or adjusted under 35 U.S.C. 154(b) by 45 days.

(21) Appl. No.: 09/665,275

(22) Filed: Sep. 19, 2000

(51) Int. Cl.[7] ..... B26B 11/00; G10K 5/00
(52) U.S. Cl. ..... 116/137 R; 7/118
(58) Field of Search ..... 116/137 R; 7/118; 81/440; 30/155, 340, 161

(56) References Cited

U.S. PATENT DOCUMENTS

| | | | | | |
|---|---|---|---|---|---|
| 632,184 | A | * | 8/1899 | Johnson | 446/206 |
| 2,722,153 | A | * | 11/1955 | Greco | 84/375 |
| 2,739,065 | A | * | 3/1956 | Hugin | 426/104 |
| 4,001,909 | A | | 1/1977 | Erickson | 15/105 |
| 4,194,714 | A | | 3/1980 | Schultz | 248/308 |
| 4,238,862 | A | | 12/1980 | Leatherman | 7/128 |
| 4,349,960 | A | * | 9/1982 | Kwasniak | 30/153 |
| 4,380,232 | A | | 4/1983 | Doyle | 128/201.11 |
| 4,408,394 | A | * | 10/1983 | Phelps | 30/157 |
| 4,669,140 | A | | 6/1987 | Miceli | 7/158 |
| 4,744,272 | A | | 5/1988 | Leatherman | 81/427.5 |
| D301,513 | S | | 6/1989 | Wright | D22/117 |
| 4,854,045 | A | * | 8/1989 | Schaub | 30/155 |
| 4,918,775 | A | * | 4/1990 | Leu | 7/168 |
| 4,945,790 | A | | 8/1990 | Golden | 81/57.14 |
| 5,001,462 | A | | 3/1991 | Seemann | 340/574 |
| 5,029,354 | A | * | 7/1991 | Boyd et al. | 7/118 |
| 5,077,850 | A | | 1/1992 | Brubaker | 7/151 |
| 5,124,898 | A | | 6/1992 | Chabria | 362/253 |
| 5,313,376 | A | | 5/1994 | McIntosh | 362/119 |
| 5,442,529 | A | | 8/1995 | Hoover | 362/119 |
| 5,461,786 | A | * | 10/1995 | Miller | 30/161 |
| 5,475,368 | A | | 12/1995 | Collins | 340/574 |
| 5,497,522 | A | | 3/1996 | Chen | 7/128 |
| 5,531,365 | A | | 7/1996 | Donnelly | 224/576 |
| 5,557,294 | A | | 9/1996 | Leslie | 345/32 |
| 5,611,615 | A | * | 3/1997 | Jang | 362/119 |
| 5,653,525 | A | * | 8/1997 | Park | 362/119 |
| 5,664,274 | A | | 9/1997 | Collins | 7/129 |
| 5,694,692 | A | * | 12/1997 | Reinschreiber | 30/155 |
| 5,857,268 | A | * | 1/1999 | Park | 30/146 |
| 6,065,238 | A | * | 5/2000 | Carter et al. | 43/4 |
| 6,286,397 | B1 | * | 9/2001 | Taggart et al. | 81/63.1 |

FOREIGN PATENT DOCUMENTS

| | | | | |
|---|---|---|---|---|
| WO | WO 92/02341 | * | 7/1991 | B26B/11/00 |

* cited by examiner

*Primary Examiner*—Diego Gutierrez
*Assistant Examiner*—R. Alexander Smith

(57) ABSTRACT

A whistle attachment is shown for a multi-implement tool which may be of the folding knife type. The whistle is attached and located in a manner to provide quick and easy access to the whistle in an emergency situation such as an attack or potential attack by a miscreant. The whistle is made for attachment to the existing structure of the tool to provide economy and ease of manufacture. In a preferred embodiment the whistle is made for use by blowing by mouth into an opening in the whistle. This avoids the potential for failure of a power source if battery or other power means were used to sound the whistle. The whistle also serves as a decorative cover for a multi-implement tool and does not depend on any structure of the tool to complete the whistle.

3 Claims, 2 Drawing Sheets

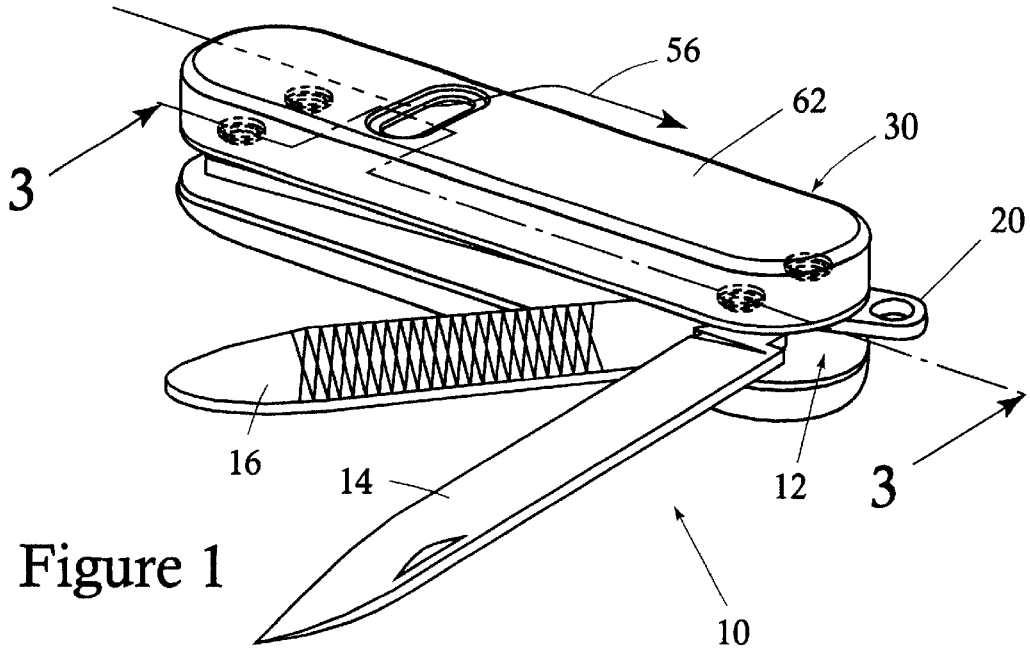
Figure 1
Figure 4
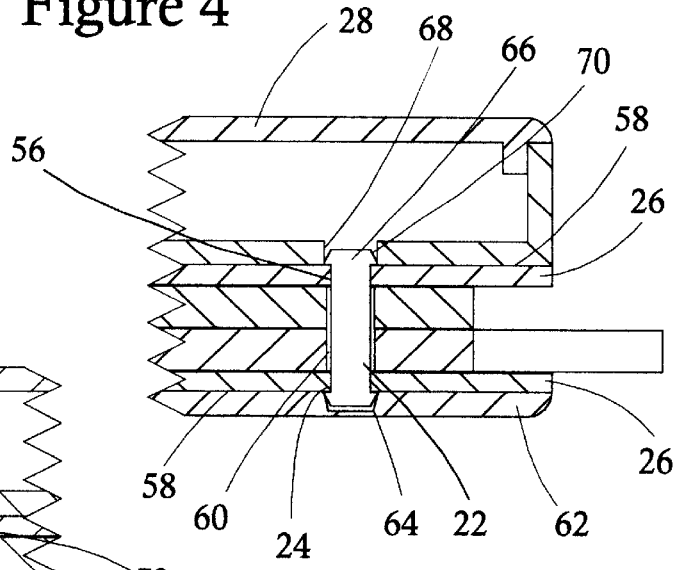
Figure 5
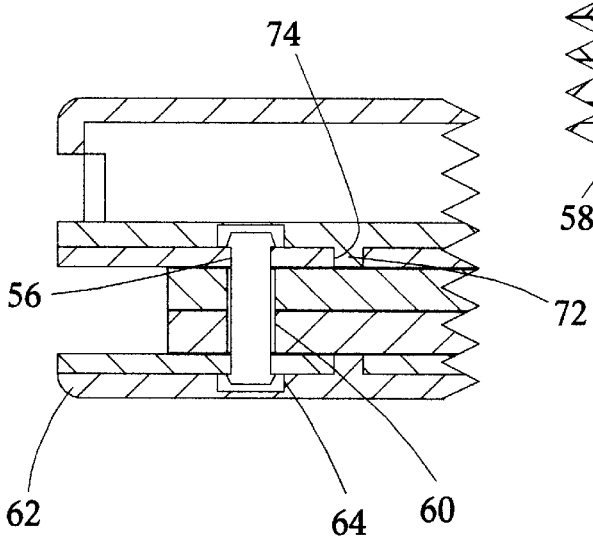

WHISTLE FOR MULTI-IMPLEMENT FOLDING KNIFE

FIELD OF THE INVENTION

This invention relates to multi-implement pocket tools especially those of a folding knife type and particularly such a tool which includes a whistle as one of the implements or in which a whistle is incorporated in the body of the tool.

BACKGROUND OF THE INVENTION

Multi-implement pocket tools are well known in the prior art. Many of these are of the folding knife type in which one or more of the implements may be a knife blade or similar tool and in which some or all of the tools are movable from a storage position in which the implement is folded within the body of the tool which can then be placed in a pocket to an active position in which the implement is locked into a position where the tool can be used for its intended purpose. Among the more common implements incorporated in such tools are knife blades, fingernail files, screwdrivers, bottle cap removers, scissors and cork screws. As small batteries have become more powerful and long lasting, battery operated lamps or flashlights have also been made one of the items incorporated in such tools.

Although security or alarm whistles have been promoted for use by vulnerable persons when they feel in danger of imminent or potential danger, no one has incorporated such a whistle into the integral structure of a multiple implement tool such as is disclosed by the present invention. In the meantime, there are many stories of attacks and holdups in isolated streets or parking lots in which the victim could have summoned assistance or the attacker been frightened away by a loud, shrill blast of a whistle. Just startling the perpetrator could give the intended victim the opportunity to escape.

SUMMARY OF THE INVENTION

According to the present invention there is provided a molded plastic whistle which forms one part of the housing which provides the finishing structure on each side of a multi-implement tool. The type of housing referred to is usually molded of plastic or made of similar material and secured to the spine, frame or structural base of the tool. It is necessary to change only one side of the housing to incorporate the whistle in the instant invention. The remaining portions of the tool are not changed. This makes it easy to manufacture the tool of the invention and keep the cost low.

Although batteries have been improved over the years, they still have a finite shelf life and power capacity. In other words it is possible that at any specific time the battery will cease to function and be unable to operate the device that it powers. Since the whistle which is incorporated in this invention is intended for use as an emergency or alarm signal it is undesirable to have it dependent on a battery which may stop working when needed. Therefore, the whistle is of the manual type, that is of the type blown by mouth.

Further in keeping with the emergency character of the device, the whistle is made fixed in position with respect to the spine of the tool and accessible without having to determine which of the multiple implements incorporates the whistle, then pivoting it into its active or functioning position and finally activating the whistle. In the present invention, the whistle is part of the outside housing and is always accessible to a person grasping the tool or knife. As used herein the word "knife" may be used to refer not only to an implement in the nature of a cutting blade, but also to the entire tool including implements useful for other purposes. The vast majority of tools of the multi-implement type include a cutting blade and incorporate folding mechanisms and over-all structure similar to that used in a simple folding pocket knife.

In a preferred form of the invention, the knife or tool comprises a rigid spine or frame which provides a structural base for the entire assembly. Each of the tools is attached to the spine preferably by pivots which permit each implement to be selectively placed in an active or stored position. The frame may include spacers which also provide spring tension to bias the individual tools into their active and/or stored positions. The outer sides of the multiple tool are covered by a cover or covers which help complete the multi-implement tool and which also serve as decorative or finishing members. In a preferred form of the invention one of these covers is constructed to be a whistle. The whistle may be made of one or more pieces. In a further preferred form the whistle is made of molded plastic or similar material in two pieces. One of the pieces is in the form of a flat, relatively thin base member which has a vertically extending peripheral wall of uniform height. This base member is secured to the spine of the knife by suitable means such as screws or rivets or by welding or cementing with an available bonding material. The second piece is a substantially flat cover which matches the first piece and with the base member forms a closed hollow chamber. An opening is provided at one end of the chamber and communicates with the inside of said chamber. An opening or slit is provided in the flat cover and also communicates with the inside of the chamber. When air is forced into the opening in the end of the chamber and out the slit in the flat cover it produces a whistling sound. A very loud, shrill whistle can be produced in this manner as is well known in the art.

In a well known embodiment of a multiple implement tool, the overall length of the knife or tool is about four inches, the width is about three quarters of an inch and the thickness is about an inch. The plan view dimensions of the cover which forms the whistle are substantially the same as those of the overall tool, that is about four inches long and three quarters of an inch wide, with the thickness being about one quarter of an inch. The opening in the end of the cover may be round, rectangular or any other geometric shape and the slit or slot in the cover may be of any size and/or shape which produces a loud, shrill sound. In one example of a preferred embodiment, the slit is a straight slot about a half inch long and one eighth inch in width.

The base portion of the whistle also has an abutment which may be integral therewith, extends across the width of the base and is integrally connected to the peripheral wall at each of its ends. The effective opening in the cover through which air escapes is determined by the size and relative position of the slot relative to the abutment. The base portion of the whistle, the abutment and the effective size of the opening comprise a valve which controls the final opening through which air may escape from the whistle and therefore the intensity and pitch of the sound. In a preferred form, the abutment is positioned somewhat toward the end of the base on which lies the opening for introducing air into the chamber.

It is within the skill of a person conversant in the art of manufacturing a product like that here discussed to suggest and/or utilize an almost endless variety of means for attaching a whistle to a multi-implement tool based on the structure of such tool and the economics, efficiencies and effectiveness of the manufacture of the complete product. A few of the possible means for securing the whistle to the tool are shown and/or described but the list is not exhaustive or exclusive. It is the intent of the inventors to disclose a whistle for attachment to a multi-implement tool in a relatively permanent manner with the whistle being accessible at all times from the outside of the tool without having to move or manipulate any of the movable parts of the tool. Although a preferred mode is disclosed wherein the whistle is operated by the user blowing into the inlet opening of the whistle, that is, by "manual" operation, it is within the skill of a mechanic familiar with the art, to use a whistle or oscillator or vibrator operated by power from a battery or other device to produce a "power" operation. The specific structures herein disclosed are intended to illustrate by way of example, the "best mode" of carrying out the invention and not to limit the invention.

In a preferred form of the invention, the whistle is made for use with a type of multi-implement tool which is made of metal and at least some of the individual implements are attached to metal pivots or posts which also serve to join the parts of the multi-implement tool into a substantially integral structure. In a form of the invention in which the whistle is made of plastic, the whistle body can be made with a shape substantially matching the outline of the tool and having holes aligned with some or all of the posts. The posts are extended in length so that they will protrude into the openings in the whistle body to provide a means of attachment. The fit between the posts and the openings can be a snug fit, a snap fit or an interference fit. A snug fit is used to describe the case where the size of the hole is the same as or just slightly larger than the size of the post that it mates with. A snap fit refers to a case where the size of the hole is the same as or very slightly smaller than a first part of the post over which it is assembled and very slightly larger than a second part of that post. In a snap fit the holes in the whistle body have to be slid over the first part of the post with some force and will "snap"into place over the smaller part of the post. An interference fit refers to the case where the hole is smaller than the post over which it fits and requires deformation of the material of one or the other or both in order to effect assembly. In all cases, a bonding or cementing material may be used to strengthen the attachment of one part to the other or as the sole means of such attachment or the posts and holes can be eliminated entirely and the assembly accomplished solely by bonding or cementing the whistle body directly to a suitable surface of the multi-implement tool.

The specific structure of the multi-implement tool or the details of its construction may be selected from many forms available in the prior art and do not form any part of the invention except to the extent that the whistle must be made to be complementary to the structure of the tool so that it can be attached to the tool but without interfering with its ordinary usage.

In all cases the posts or even the mating holes in the body of the whistle may be tapered to help make assembly of the parts easier. The provision of a readily accessible whistle, integrated with the existing structure of a multi-implement tool, without requiring appreciable change in the tool or the manufacturing processes used to make it and without unduly increasing the cost of making it are the objects and intent of this invention and it will be obvious to persons familiar with the art that there are many specific means for accomplishing them without departing from the scope of the invention.

Objects and Advantages of the Invention

It is one of the objects of this invention to provide a multi-implement tool having a whistle forming an integral part of the body of said tool and readily accessible to a person carrying the tool.

Another object of the invention is to provide such a tool by the modification of existing multi-implement tools wherein such modification requires a minimum of alteration of the structure or of the mode and methods of manufacture of the existing product.

Still another object of this invention is to produce the desired product with a minimal added cost over the cost of producing the existing tool.

It is a further object of this invention to provide a multi-implement tool having a whistle which can be used as an alarm by a person carrying the tool to startle or frighten away a potential miscreant.

Another object of this invention is to provide such a tool based on an existing multi-implement tool without requiring any change in the basic structure of the existing tool.

Yet another object of this invention is to provide such a tool based on an existing multi-implement tool wherein there is no negative effect on the use or accessibility of the individual tools comprising the multi-implement tool.

It is an object of this invention to provide a whistle for attachment to a multi-implement tool.

It is also an object of this invention to provide a whistle for attachment to a multi-implement tool, which whistle also serves as a decorative cover for the tool.

Yet another object of this invention is to provide such a whistle which can readily be secured to existing forms of multi-implement tools.

It is also among the objects of this invention to teach the use of known modes of attachment of two parts to the joining of a whistle to a multi-implement tool of known form or forms.

It is also an object of this invention to provide a decorative cover for a multi-implement tool which cover also functions as a whistle.

These and other objects and advantages of this invention will become readily apparent to those persons skilled in the art from the following detailed description, particularly when such description is reviewed in conjunction with the attached drawings and appended claims.

BRIEF DESCRIPTION OF THE DRAWINGS

FIG. 1 is a perspective view of the invention attached to a multi-implement tool and showing a few of the individual tools attached to the multi-implement tool which may be included on typical multi-implement tools, some of the tools being shown in partially open or active position.

FIG. 4 is a partial cross-sectional view taken through one of the pivots and enlarged to show greater detail.

FIG. 5 is a view similar to that shown in FIG. 4 of another means of attaching the whistle to the body of the tool 10.

DETAILED DESCRIPTION OF THE INVENTION

Figure 2:
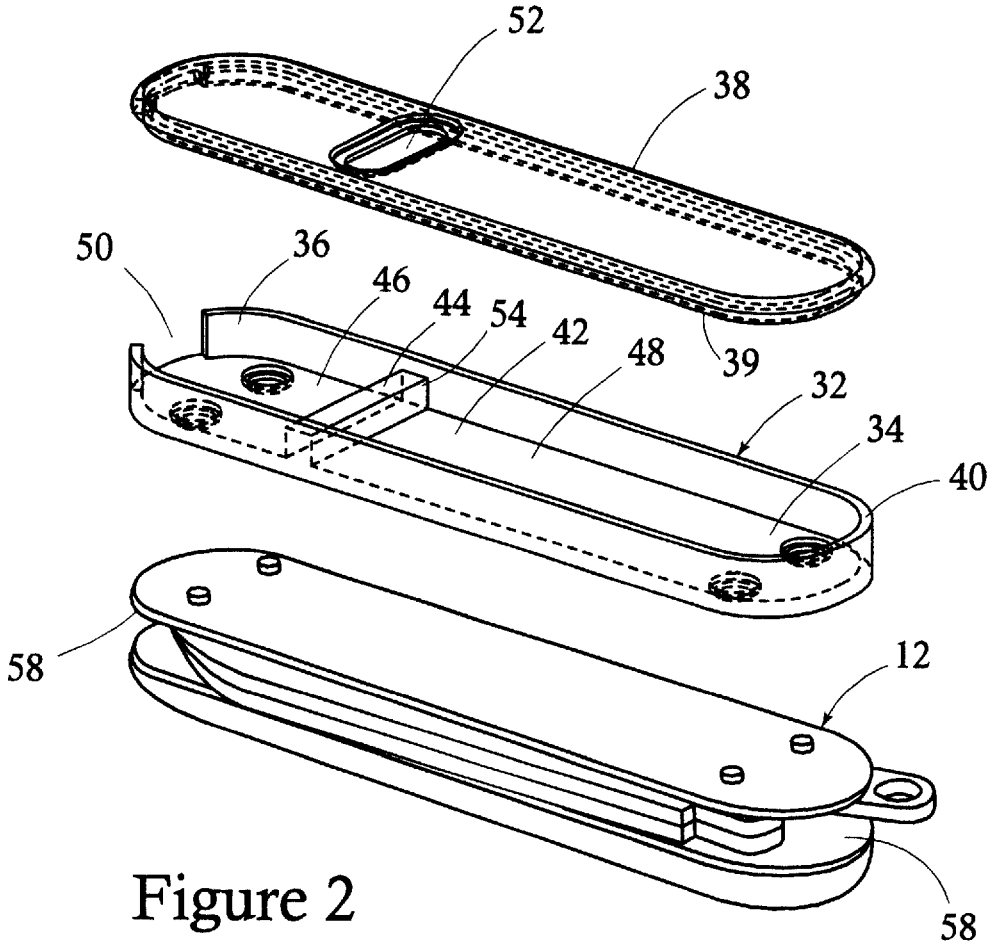
FIG. 2 is an exploded view of a multi-implement tool with a whistle cover as taught by the invention.

In the drawings like parts are indicated by like reference numbers in the different views for the sake of clarity and ease of understanding:

Turning now to the drawings, FIG. 1 shows a multi-implement tool 10 having a spine or frame 12 which supports a variety of individual specific tools, such as for example, knife blade 14, fingernail file 16, and key ring holder 20. The individual tools are secured to the spine by means of pivot posts 22 fastened to the spine by riveting, welding or other suitable means as illustrated at 24.

The tools are rotatable on the posts 22 so that they may swing from a stored position in which they are substantially enclosed within the spine to an active position in which they extend outside the spine and can be used to perform their useful function.

The spine or frame of the tool 10 may include flat plates 26 made of metal or other suitable material and posts 22 fastened to the plates in a manner to create an integral structure for supporting the individual tools. In a preferred form of the inventions the spine or frame 12 has attached to at least one side thereof a finishing or decorative cover 28 which may be made of plastic, bone, leather, wood or any one of many materials suitable for this purpose, known and/or previously used in the prior art or hereafter available. In the present invention, a cover is provided for at least one side of the tool in the form of a whistle 30. In a preferred form of the invention, the whistle 30 is made of two die cast parts as shown in FIG. 2.

Figure 3:
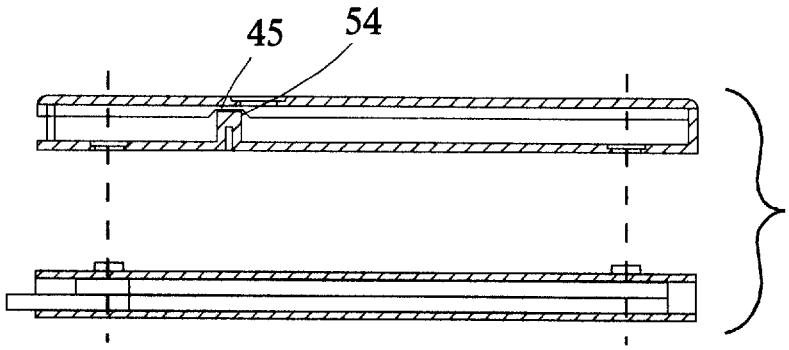
FIG. 3 is a cross-sectional view of a multi-implement tool and a whistle attachment taken along the line 3—3 in FIG. 1, with the tools in stored position and without a bottom cover.

One part of the whistle 30 is a housing 32 having a base 34 and an upstanding peripheral wall 36 of even height. A relatively flat cover 38 is secured to the upper edge 40 of wall 36 by suitable means such as welding, fusing, cementing, or similar means to form an air-tight enclosure defining the space 42. The housing 32 also has an integral abutment or ledge 44 extending between opposed portions of the wall 36 and dividing the space 42 into two sections 46 and 48. One end of the peripheral wall 36 is provided with an opening 50 through which air may be introduced into section 46 of the space 42. The cover 38 of housing 32 has in it a slot 52 which slightly overlaps the top front edge 54 of ledge 44 creating a thin slit 45 through which air, indicated by the arrow 56 in FIG. 1, escapes into the atmosphere when blown into section 46 of space 42, creating a whistling sound. The relative areas of the opening 50 and slit 45 determine the pitch and intensity of the sound emitted by the whistle. As seen in FIGS. 2, 3 and 4 the cover 38 may have a thickened peripheral portion 39 which helps register the cover 38 with the peripheral wall 36 and to seal the edges of the chamber 42 to form a whistle.

FIG. 4 shows one form of construction of a multi-implement tool and one possible manner of connecting a whistle and/or cover to such an implement. Pivot posts 22 may be connected to the spine or frame of the tool by passing the end of the post through holes 56 in the plates 26 and riveting or overturning the posts on the inner side 58 of the plates. The pivot posts also pass through corresponding holes 60 in the implements so that the implements can rotate about the posts 22 as previously described but are held in assembled rotation with the rest of the tool. A decorative cover 62 may be attached to one side of the tool and a whistle may be attached to the other side as will now be described. The cover 62 is provided with bores 64 located in matching relation to the position of posts 22 and of substantially the same size as the adjacent portion 66 of the post. When decorative cover 62 is positioned so that the bores 64 are in alignment with the ends 66 of each of the corresponding posts, pressure can be put on the cover 62 until the bores in the cover snap on over the posts and hold the cover securely in position. This form of assembly allows the parts to be joined in a manner which does not interfere with the aesthetic appearance of the tool. Only the smooth, unbroken surface of the cover being visible. Of course, as previously stated many other means of assembling the cover to the tool are known and available. The method of assembling the whistle to the tool is similar and will now be described.

The base 34 of housing 32 is provided with through bores 68 which are located in alignment with the posts 22 when the parts are located relative to each other in the intended position of attachment. The bores 68 are substantially of the same size as the posts 22 so they can be pressed onto the ends 70 of the posts with some pressure. The ends 70 of the posts may be slightly tapered to aid in assembling the cover and whistle to the tool. This taper is exaggerated in the drawing for the purpose of illustration but in actual fact may be very slight, for example, sufficient only to produce a difference in the diameter of the post at the reduced end compared to the larger end of perhaps a few thousandths of an inch.

Still another method of attaching the whistle to the tool, particularly when the whistle is made of plastic is shown in FIG. 5. The bottom of the base 34 is provided with integral, cylindrical connecting pins or posts 72 which can be registered with and inserted in bores 74 in the flat plates 26 of the tool to hold the parts in assembled position. The pins 72 may be cast integrally with base 34.

As can be seen, the whistle 30 is securely fastened to a multi-implement tool utilizing as much as possible, the existing structure of the tool to which it is attached. This makes it practical and economical to construct the finished product. Rigid attachment of the whistle to the exterior of the tool and in a fixed position make it easy for a person to use the whistle in an emergency situation. In fact, persons who sense that they are in a potentially dangerous circumstance may have the whistle in hand, ready to blow, rather than having to search for it in a pocket or purse. For example, a person walking to his or her automobile in a dark or remote part of a parking facility may very well carry the tool in their hand oriented for putting to their lips to sound a loud shrill blast.

While we have shown and described specific embodiments of the invention, many variations and alternatives may be made to the arrangements and configurations shown without departing from the objects and scope of the invention as exemplified by the means and structures recited in the following claims and their obvious equivalents.

What we claim is:

1. A whistle for attachment to a multi-implement pocket tool, said tool characterized by having a spine with first and second sides and having means for securing implements to said spine; the whistle comprising:

a substantially air tight space enclosed within a hollow housing, said hollow housing including a base for attachment to one of the first and second sides of said spine and means for relatively immovably attaching the whistle to said spine, said hollow housing having a first opening at one end through which air may be blown by mouth into said enclosed space to activate the whistle, said hollow housing further including a restricted second opening through which said air blown into said hollow housing escapes producing a whistling sound, said means for securing implements to said spine including at least one pivot post, said means for relatively immovably attaching the whistle to said spine including an extension of said at least one pivot post and at least one aperture extending through said base into said enclosed space, said at least one extension passing through said aperture and terminating in said enclosed space within said hollow housing.

2. A whistle as set forth in claim 1 wherein said at least one aperture includes a tapered portion adjacent said extension of said pivot post to facilitate a snap-fit assembly and wherein said enclosed space includes an abutment extending across the enclosed space adjacent said second opening and controls the size and shape of said second opening through which air escapes and therefore the pitch and intensity of the whistling sound which is produced when the whistle is activated, and wherein said whistle is an integral unitary decorative cover for the tool to which it is attached.

3. A decorative one piece cover for a multi-implement pocket tool, said tool including a spine and said cover comprising:

an enclosed hollow body, said enclosed hollow body including a base adjoining a periphery of said spine, said base being congruent with the adjoining periphery of said spine, a vertically extending continuous peripheral wall integral with said base, a space enclosed by the top cover, the base, and the peripheral wall, and securing means for securing the decorative cover to the tool, said securing means including apertures extending through the base of said enclosed hollow body into said space, said securing means for securing the decorative cover not being visible externally of the tool and cover when the tool and cover have been secured to each other, said enclosed hollow body having a first opening for blowing air into said space and a second opening for expelling said blown air, a whistle having means for producing a whistling sound, said whistle including said space, said first opening and said second opening.

* * * * *